US010652637B2

(12) United States Patent
Zhao et al.

(10) Patent No.: US 10,652,637 B2
(45) Date of Patent: May 12, 2020

(54) AUDIO SPEAKER AND METHOD OF PRODUCING AN AUDIO SPEAKER

(71) Applicant: KING ABDULLAH UNIVERSITY OF SCIENCE AND TECHNOLOGY, Thuwal (SA)

(72) Inventors: Jiajun Zhao, Thuwal (SA); Ying Wu, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 0 days.

(21) Appl. No.: 16/475,608

(22) PCT Filed: Dec. 7, 2017

(86) PCT No.: PCT/IB2017/057735

§ 371 (c)(1),
(2) Date: Jul. 2, 2019

(87) PCT Pub. No.: WO2018/162969

PCT Pub. Date: Sep. 13, 2018

(65) Prior Publication Data

US 2019/0327545 A1 Oct. 24, 2019

Related U.S. Application Data

(60) Provisional application No. 62/468,471, filed on Mar. 8, 2017.

(51) Int. Cl.

| | |
|---|---|
| ***H04R 1/02*** | (2006.01) |
| ***H04R 1/28*** | (2006.01) |
| ***H04R 1/34*** | (2006.01) |

(52) U.S. Cl.

CPC ..... *H04R 1/021* (2013.01); *H04R 1/2857* (2013.01); *H04R 1/345* (2013.01)

(58) Field of Classification Search

None

See application file for complete search history.

(56) References Cited

U.S. PATENT DOCUMENTS 5,821,471 A * 10/1998 McCuller ..... H04M 1/035 181/156

7,284,638 B1 10/2007 Sahyoun (Continued)

FOREIGN PATENT DOCUMENTS

WO 2015129969 A1 9/2015

OTHER PUBLICATIONS

Cheng, Y., et al., "Ultra-Sparse Metasurface for High Reflection of Low-Frequency Sound Based on Artificial Mie Resonances," Nature Materials, Articles, Aug. 31, 2015, vol. 14, pp. 1013-1019.

(Continued)

*Primary Examiner* — Qin Zhu

(74) *Attorney, Agent, or Firm* — Patent Portfolio Builders PLLC

(57) ABSTRACT

A speaker includes a speaker enclosure. The speaker enclosure includes an inner region arranged in a center of the speaker enclosure and an outer region, which surrounds the inner region and includes a plurality of channels connecting the inner region to an environment in which the speaker enclosure is arranged. The speaker also includes a sound transducer arranged in the inner region in the center of the speaker enclosure. Sound produced by the sound transducer radiates through the plurality of channels into the environment. A length of each of the plurality of channels is greater than a length from the center of the speaker enclosure to the environment.

20 Claims, 7 Drawing Sheets

(56) References Cited

U.S. PATENT DOCUMENTS

| | | | | |
|---|---|---|---|---|
| 8,744,114 | B1 * | 6/2014 | Lowchareonkul | H04R 1/02 381/345 |
| 2003/0150668 | A1 * | 8/2003 | Nichols | H04R 1/2857 181/193 |
| 2004/0245042 | A1 * | 12/2004 | Nevill | H04R 1/345 181/151 |
| 2010/0183179 | A1 * | 7/2010 | Griffin, Jr. | H04R 1/2857 381/337 |
| 2013/0327585 | A1 | 12/2013 | Murray | |
| 2015/0382103 | A1 * | 12/2015 | Powell | H04R 1/2853 381/338 |
| 2017/0069303 | A1 * | 3/2017 | Song | H04R 1/345 |

OTHER PUBLICATIONS

Cheng, Y., et al., "Ultra-Sparse Metasurface for High Reflection of Low-Frequency Sound Based on Artificial Mie Resonances," Nature Materials, Supplementary Information, Aug. 31, 2015, pp. 1-17.

International Search Report in corresponding/related International Application No. PCT/IB2017/057735, dated Mar. 13, 2018.

Written Opinion of the International Searching Authority in corresponding/related International Application No. PCT/IB2017/057735, dated Mar. 13, 2018.

Zhao, J. et al., "Enhancing Monochromatic Multipole Emission by a Subwavelength Enclosure of Degenerate Mie Resonances," The Journal of the Acoustical Society of America, American Institute of Physics for The Acoustical Society of America, New York, NY, US, Jul. 6, 2017, vol. 142, No. 1, pp. EL24-EL29.

* cited by examiner

AUDIO SPEAKER AND METHOD OF PRODUCING AN AUDIO SPEAKER

CROSS-REFERENCE TO RELATED APPLICATIONS

This application is a U.S. National Stage Application of International Application No. PCT/162017/057735, filed on Dec. 7, 2017, which claims priority and benefit from U.S. Patent Application No. 62/468,471, filed on Mar. 8, 2017, entitled "ENCLOSURE FOR ENHANCING SOUND SOURCES' RADIATION RATE", the disclosures of which are incorporated herein by reference.

BACKGROUND

Technical Field

Embodiments of the subject matter disclosed herein generally relate to an audio speaker and method of making an audio speaker.

Discussion of the Background

The miniaturization of electronics, such as telephones, tablets, laptops, etc., has required smaller speakers to fit within the smaller enclosures. Speakers that are much smaller than the sound wavelength have extremely low radiation efficiency/rate at low frequencies, for example, for frequencies in the range of 20-200 Hz. The majority of low-frequency acoustic energy emitted by a conventional audio speaker is stored in the vicinity of the speaker structure as near-field oscillation instead of being radiated far in the ambient medium, such as air or water.

Existing efforts to enhance source radiation efficiency/rate distort the radiation directivity of the sound source. Directivity is an important characteristic for sound sources, and is particularly critical in certain applications. For example, monopole sources are typically employed for radiating low-frequency sounds in all directions, i.e., they have an omnidirectional radiation pattern. However, existing attempts to enhance radiation efficiency/rate typically affect the radiation pattern so that the sound source no longer produces an omnidirectional sound pattern.

One way of enhancing a sound source's radiation efficiency/rate is to design a woofer diaphragm to be much larger than the wavelength of low-frequency sounds. This has limited impact on the sound source's radiation efficiency/rate and due to its large size does not produce omnidirectional sound at low frequencies. Another way of enhancing a sound source's radiation efficiency/rate is to form the loudspeaker's mouth into a horn shape, which enhances sound radiation and confines the radiation space but this also affects the sound source's directivity. Yet another way to enhance a sound source's radiation efficiency/rate is to use an acoustic metamaterial using Fabry-Perot resonances to enhance monopole radiation but this speaker does not preserve the sound source's directivity. Those skilled in the art will recognize that an acoustic metamaterial is a material engineered to have a property that is not found in nature.

Thus, there is a need to enhance a speaker's sound source's efficiency/rate without affecting the sound source's directivity.

SUMMARY

According to an embodiment, there is a speaker, which includes a speaker enclosure. The speaker enclosure includes an inner region arranged in a center of the speaker enclosure and an outer region, which surrounds the inner region and includes a plurality of channels connecting the inner region to an environment in which the speaker enclosure is arranged. The speaker also includes a sound transducer arranged in the inner region in the center of the speaker enclosure. Sound produced by the sound transducer radiates through the plurality of channels into the environment. A length of each of the plurality of channels is greater than a length from the center of the speaker enclosure to the environment.

According to another embodiment, there is a method of producing a speaker. A speaker enclosure is provided, which includes an inner region arranged in a center of the speaker enclosure and an outer region which surrounds the inner region and includes a plurality of channels connecting the inner region to an environment in which the speaker enclosure is arranged. A sound transducer is arranged in the inner region in the center of the speaker enclosure. Sound produced by the sound transducer radiates through the plurality of channels into the environment. A length of each of the plurality of channels is greater than a length from the center of the speaker enclosure to the environment.

According to yet another embodiment, there is an omnidirectional speaker, which includes an annular speaker enclosure. The annular speaker enclosure comprises an inner region arranged in a center of the annular speaker enclosure and an outer region, which surrounds the inner region and includes a plurality of channels connecting the inner region to an environment in which the annular speaker enclosure is arranged. The omnidirectional speaker also comprises a sound transducer arranged in the inner region in the center of the annular speaker enclosure. Sound produced by the sound transducer radiates through the plurality of channels into the environment. A length of each of the plurality of channels is greater than a radius of the annular speaker enclosure.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of an audio speaker. However, the embodiments to be discussed next are not limited to audio speakers.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1A:
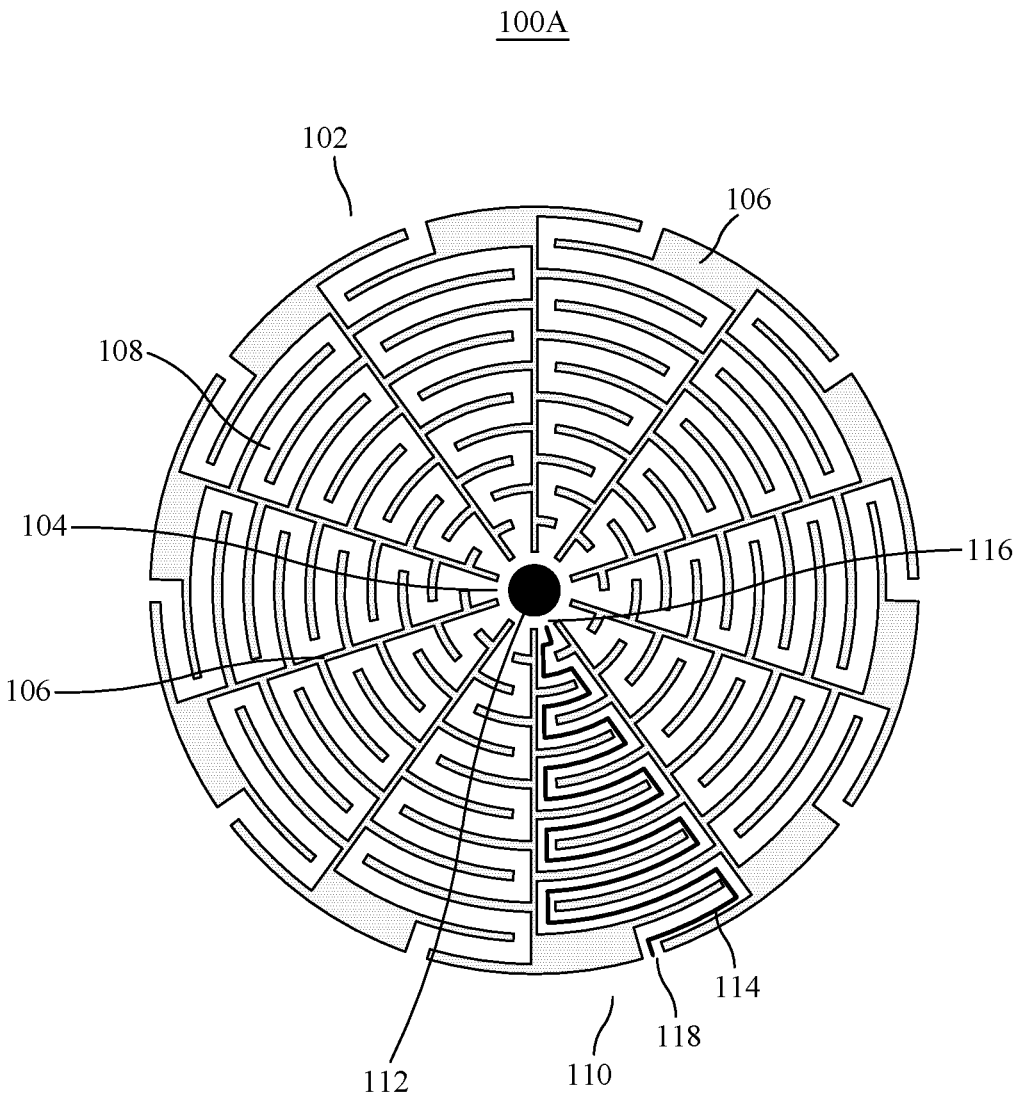
FIG. 1A is a schematic diagram of a speaker according to an embodiment.

Turning first to FIG. 1A, a speaker 100A includes a speaker enclosure 102. The speaker enclosure includes an inner region 104 arranged in a center of the speaker enclosure 102 and an outer region 106, which surrounds the inner region 104 and includes a plurality of channels 108 connecting the inner region 104 to an environment 110 in which the speaker enclosure 102 is arranged. The speaker 100A also includes a sound transducer 112 arranged in the inner region 104 in the center of the speaker enclosure 102. Sound produced by the sound transducer 112 radiates through the plurality of channels 108 into the environment 110. A length of each of the plurality of channels 108 is greater than a length from the center of the speaker enclosure 102 to the environment 110.

In the illustrated embodiment, the plurality of channels 108 are serpentine so that sound produced by sound transducer 112 follows a serpentine path 114 from an opening 116 between the inner region 104 and the outer region 106 to an opening 118 between the outer region 106 and the environment 110. This serpentine path provides each of the channels with a length that is greater than a length from the center of the speaker enclosure 102 to the environment, which in the illustrated speaker enclosure 102 corresponds to its radius.

Although FIG. 1A illustrates only a single path 114 from the inner region 104 to the environment 110, each of the plurality of channels 108 provides a path from the inner region 104 to the environment 110. The annular shape of speaker 100A produces omnidirectional sound, which is particularly advantageous for low frequency sound typically produced from a woofer, which is in the range between 20-200 Hz. However, the sound transducer 112 is capable of producing sounds of any frequency typically produced by a speaker.

Figure 1B:
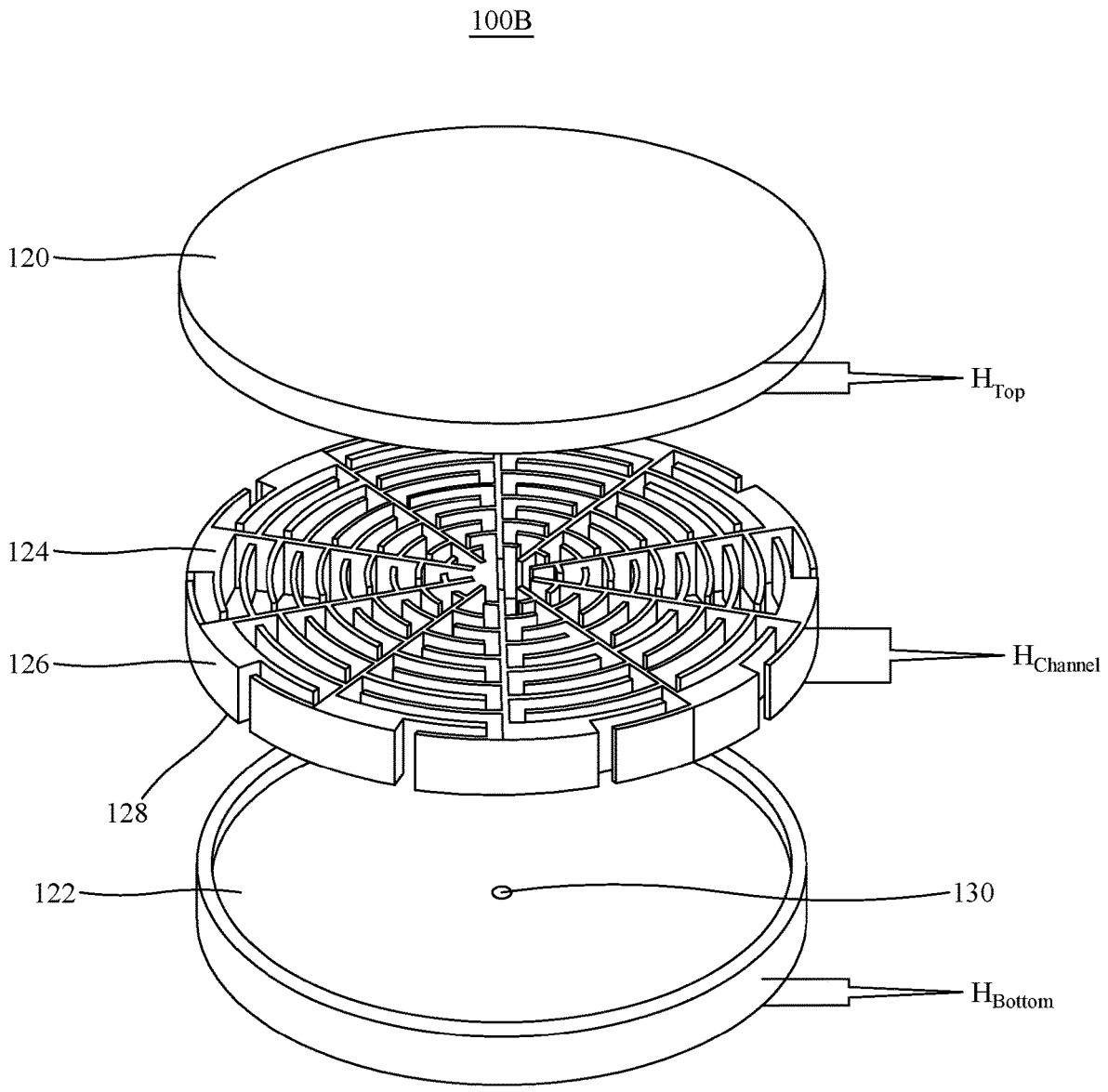
FIG. 1B is another schematic diagram of a speaker according to an embodiment.

FIG. 1B is another schematic diagram of a speaker 100B according to an embodiment, which illustrates the speaker enclosure 102 including a top cap 120 and bottom cap 122. Because the speaker enclosure 102 is annular in this embodiment, the top cap 120 and bottom cap 122 will likewise have an annular shape. This schematic diagram illustrates the top cap 120 and bottom cap 122 apart from the other portions of the speaker enclosure 102 for ease of illustration. However, when implemented, the top cap 120 is arranged on a top surface 124 of the plurality of channels 108 and overhangs side surfaces 126 of the plurality of channels 108. Similarly, when implemented, the bottom cap 122 is arranged on a bottom surface 128 of the plurality of channels 108 and overhangs the side surfaces 126 of the plurality of channels 108. Although the bottom surface 128 is obscured in FIG. 1B, it will have a similar arrangement to the top surface 124.

The portions of the top cap 120 and bottom cap 122 overhanging the side surfaces 126 of the plurality of channels 108 can have a total length equal to the height of the plurality of channels 108, i.e., $H_{Top}+H_{Bottom}=H_{Channel}$. This can be achieved by having the portions of the top cap 120 and bottom cap 122 overhanging the side surfaces having an equal height, i.e., $H_{Top}=H_{Bottom}=2*H_{Channel}$. Alternatively, the portions of one of the top cap 120 or bottom cap 122 can have a greater height than the other and the total height of these portions is approximately equal to the height of the plurality of channels 108. In other embodiments, the heights of the portions of the top cap 120 and bottom cap 122 overhanging the side surfaces 126 of the plurality of channels 108 can be arbitrary so long they contain the sound to propagate along the plurality of channels 108.

As also illustrated in FIG. 1B, the center of the bottom cap 122 includes an opening 130 to hold the sound transducer 112. The opening can pass through the bottom cap to allow the sound transducer 112 to be connected to a device providing the sound (not illustrated). However, the speaker 100B can be self-contained by including a device providing the sound and the transducer, in which case the opening 130 need not pass through the bottom cap because external connections are unnecessary. This alternative can be employed, for example, when the speaker 100B is a wireless speaker, such as a Bluetooth speaker with an internal power source. The speaker enclosure illustrated in FIG. 1B produces three-dimensional sound, which radiate out of the enclosure.

The plurality of channels 108 can be filled with a fluid, such as air or a liquid, depending upon implementation. The walls of the plurality of channels are rigid to provide a stark contrast of the acoustic impedance to the plurality of channels 108. This stark contrast can be achieved using, for example, brass, acrylonitrile butadiene styrene (ABS), or any other material exhibiting a high acoustic impedance compared to the low acoustic impedance of the fluid in the channels. The combination of walls made of a material exhibiting high acoustic impedance and channels filled with fluid exhibiting a low acoustic impedance results in the speaker enclosure 102 being anisotropic.

It has been found that, for both monopole and multipole sources, such an anisotropic speaker enclosure 102 exhibits emission gains at low and consistent frequencies surrounding degenerate Mie resonant frequencies of the speaker enclosure 102. In contrast, an isotropic speaker enclosure produces high and inconsistent resonant frequencies. It will be recognized that an anisotropic material is one having a physical property having a different value when measured in different directions, whereas an isotropic material is one having a physical property having the same value when measured in different directions.

In one embodiment, the speaker enclosure 102 is a subwavelength enclosure, i.e., the diameter of the speaker enclosure 102 is much smaller than the wavelength of the sound produced by sound transducer 112. Conventional speaker designs having a subwavelength enclosure exhibit a very low sound emission rate at low frequencies due to the smallness of the sound transducer compared to the large wavelength of low frequency sounds. In contrast, the use of a plurality of channels 108 having a sound path greater than the radius of the speaker enclosure 102 and the speaker enclosure 102 being anisotropic produces two-order-magnitude emission gains at extremely low frequencies surrounding the Mie resonant frequencies of the speaker enclosure, and thus an increased sound emission rate at low frequencies compared to conventional subwavelength enclosures.

Although the speaker enclosure 102 illustrated in FIGS. 1A and 1B includes ten channels, the speaker enclosure can include more than ten channels, as well as fewer than ten channels.

The speaker enclosure 102 illustrated in FIGS. 1A and 1B, as well as the other disclosed enclosures, omnidirectionally boosts the radiation rate for sound at low frequencies by using a compact enclosure implementing the acoustic Purcell effect. The traditional quantum Purcell effect holds that an atom in a wavelength-size cavity can radiate much faster than in free space. The quantum Purcell effect modifies the spontaneous emission rate of a quantum source by changing the surrounding environment. The Purcell effect originates in the field of quantum mechanics and has recently been studied in connection with electromagnetic systems but has not been studied in the acoustics field. The inventors have recognized that the acoustic Purcell effect (APE) occurs at degenerate Mie resonances.

Specifically, the inventors have recognized the APE is a consequence of enhanced density of states (DOS) of the speaker. In general, the DOS of a sound system can be expressed in terms of the Green's function G(•):

$$DOS = -\left(\frac{2\omega}{\pi c_{air}^2}\right)\mathrm{Im}\{G(\omega, \vec{r} = \vec{r_0}, \vec{r_0})\} \tag{1}$$

wherein a temporal factor $e^{-i\omega t}$ is used, Im denotes the imaginary part, $\vec{r}$ is the detector location, and $\vec{r_0}$ is the sound source location. The Green's function G(•) contains the information of the medium and Im{G} counts the number of states in that medium. The DOS can be calculated from the Green's function G(•) of the sound source using a ratio of the DOS of the sound source within the speaker enclosure $DOS_1$ and versus the sound source in free space without the speaker enclosure $DOS_0$, i.e., $$\frac{DOS_1}{DOS_0}.$$

The inventors found the ratio $$\frac{DOS_1}{DOS_0}$$

overlaps with the acoustic Purcell factor $$APF \equiv \frac{P_1}{P_0},$$

which confirms the enhanced radiation efficiency due to the DOS enhancement. The expression of the acoustic radiated power, in terms of the Green's function and the source strength of the monopole $Q_0$ is:

$$P = -0.5\omega\rho_{air}|Q_0|^2 Im\{G(\omega, \vec{r} = \vec{r_0}, \vec{r_0})\} \tag{2}$$

Comparing equations (1) and (2) demonstrates $$\frac{P_1}{P_0} = \frac{DOS_1}{DOS_0}$$

and P∝DOS. This relation is equivalent to the implication from Fermi's golden rule in quantum mechanics that the atomic emission rate is linearly dependent on the density of final states that the environment provides for spontaneous decay.

The energy emission rate of a sound source can be further characterized by its linear dependence on the real part of the radiation impedance on source surface Z. Calculating the real part of the radiation impedance on source surface Z from a ratio of the acoustic pressure and the normal velocity on the sound source surface for both a sound source with and without an enclosure, denoted by $Z_1$ and $Z_0$, respectively, results in the ratio $$\frac{\mathrm{Re}\{Z_1\}}{\mathrm{Re}\{Z_0\}}.$$

This ratio coincides with the APF calculated from the power radiated to far fields, which demonstrates an enhanced emission rate at the sound source.

As a consequence, the APE is characterized by the APF, which can be evaluated from radiated power in far fields, DOS of the sound system, or radiation impedance on the sound source surface:

$$APF \equiv \frac{P_1}{P_0} = \frac{DOS_1}{DOS_0} = \frac{\mathrm{Re}\{Z_1\}}{\mathrm{Re}\{Z_0\}} \geq 1 \tag{3}$$

At APF peaks the phase distribution of the acoustic fields in the speaker enclosure region shows a pattern of monopole degenerate Mie resonances. Further, the normalized radiation reactance $$\frac{\mathrm{Im}\{Z_1\}}{\mathrm{Im}\{Z_0\}}$$

exhibits an abrupt transition between acoustic inertance and compliance, which is also a feature of the acoustic resonances.

The speaker enclosure also can achieve APE for multipole sources with an azimuthal dependence $e^{im\theta}$. Specifically, for multipole sources of various order m≠0, the $$\frac{D}{\lambda}$$

values where APF peaks occur fall in the subwavelength region $$\frac{D}{\lambda} < 1,$$

which is also the case for a monopole source (m=0). The inventors found the APF peaks at resonances of the extremely anisotropic enclosure surprisingly occur at the same frequencies (i.e., the same $$\frac{D}{\lambda}$$

values) for different multipoles. This property is radically different from that of common Mie resonances in an isotropic enclosure, whose resonant frequencies monotonically increase with the multipole order m. These atypical Mie resonances can be referred to as degenerate Mie resonances, where the degeneracy benefits the simultaneous APE for enhancing radiation efficiency of all multipole modes of an arbitrary monochromatic sound source.

The degeneracy results from the extreme anisotropy (i.e., an extremely high density in the azimuthal direction $\rho_\theta \rightarrow \infty$) of the speaker enclosure, which can be identified from acoustic pressure fields in the speaker enclosure region $$p = R(r)(Ae^{im\theta} + Be^{-im\theta})e^{-i\omega t} \text{ where } \frac{D_i}{2} \le r \le \frac{D}{2}.$$

The radial function R(r) becomes:

$$\frac{\rho_r}{r}\frac{d}{dr}\left(\frac{r}{\rho_r}\frac{dR}{dr}\right) + \left(\frac{\omega^2}{c_r^2} - \frac{\rho_r m^2}{\rho_\theta r^2}\right)R = 0, \tag{4}$$

which is derived from the wave equation in an anisotropic medium:

$$\nabla \cdot [(\bar{\rho})^{-1}\nabla p] + \left(\frac{\omega^2}{B}\right)p = 0 \tag{5}$$

where $(\bar{\rho})$ is the mass density tensor and B is the bulk modulus. Equation (4) demonstrates that an infinite azimuthal density $\rho_\theta$ decouples the multipole order m from R(r), as well as that the frequency $\omega$ is scaled by the radial speed of sound $c_r$ of the speaker enclosure. Employing a small enclosure, such as those disclosed herein, enables the APE to systematically occur at low and consistent frequencies for both monopole (m=0) and multipole (m≠0) sources.

Equation (4) can be used to determine the resonant frequencies. Considering an anisotropic enclosure having a homogeneous density (i.e., $\rho_r$=constant), equation (4) can be solved to obtain the expression of acoustic fields in the speaker enclosure region as:

$$p = \begin{Bmatrix} J_\nu(\omega r/c_r) \\ H_\nu^{(1)}(\omega r/c_r) \end{Bmatrix} \begin{Bmatrix} e^{im\theta} \\ e^{-im\theta} \end{Bmatrix} e^{-i\omega t},\ \nu = m\sqrt{\frac{\rho_r}{\rho_\theta}} \tag{6}$$

wherein $J_\nu(\bullet)$ and $H_\nu^{(1)}(\bullet)$ are respectively the Bessel and first-kind Hankel functions of order v. The v is forced to be zero by the extreme anisotropy $\rho_\theta \rightarrow \infty$, and thus the radial functions are $J_0(\bullet)$ and $H_0^{(1)}(\bullet)$ regardless of the multipole order m in the azimuth. The disclosed enclosures have an inhomogeneous density $\rho_r(r)$, the resonant frequencies can be calculated by applying equation (5) to discretized layers of the speaker enclosure.

The disclosed enclosures are consistently within a subwavelength scale (i.e., D<λ) and is applicable to APE for any sources at low frequencies due to the extreme anisotropy $\rho_\theta \rightarrow \infty$, which induces degenerate Mie resonances at a same frequency, and the small radial sound speed $c_r$ that systematically lowers all resonant frequencies. Thus, the disclosed enclosures prominently enhance sounds at degenerate Mie resonant frequencies and can moderately enhance sounds for other frequencies.

The speaker enclosure 102 illustrated in FIGS. 1A and 1B, as well as the other disclosed enclosures, has a constant radial sound speed $c_r$ that is much smaller than the speed of sound in air $c_{air}$, and an extremely high density $\rho_\theta \rightarrow \infty$ along the azimuthal direction due to the specific configuration of the enclosure. This low value for the radial sound speed $c_r$ causes the enhancement of radiation rate to occur at low frequencies, while the infinite azimuthal density $\rho_\theta$ causes the enhancement to occur at the same frequencies for arbitrary multipole sources.

Figure 1C:
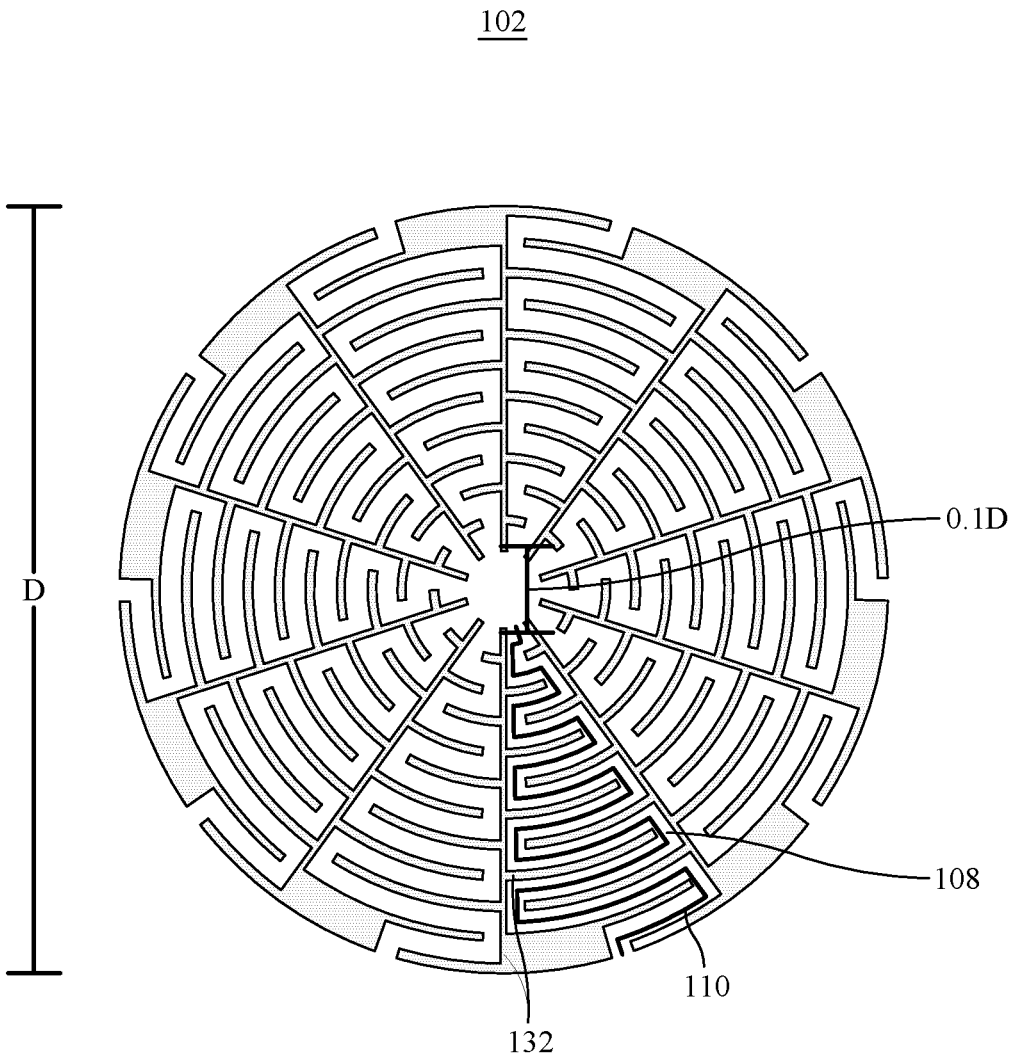
FIG. 1C is another schematic diagram of a speaker enclosure according to an embodiment.

Referring now to FIG. 1C, which corresponds to the speaker enclosure 102 in FIG. 1A, the channel 108 elongates the acoustic path 110 to achieve the low radial speed of sound $c_r$ and the rigid walls 132 separating the channels 108 achieve the extremely high azimuthal density $\rho_\theta$. The effective parameters of the speaker enclosure 102, which include the radial speed of sound $c_r$, the radial density $\rho_r$, and the azimuthal density $\rho_\theta$, depend on its geometric parameters, including the diameter of the inner region $D_i$, the diameter of the speaker enclosure D, the number of air-filled channels M, the width of the channels w, the sound path length of the channels L, and the speed of sound through air $c_{air}$. The dependence of these effective parameters is:

$$c_r = \frac{(D - D_i)c_{air}}{2L} \tag{7}$$

$$\rho_r = \frac{4\pi L \rho_{air} r}{Mw(D - D_i)} \tag{8}$$

$$\rho_\theta \rightarrow \infty \quad \text{where } \frac{D_i}{2} \le r \le \frac{D}{2}, \tag{9}$$

the speed of sound in air $c_{air}$=343 m/s, and the density of air $\rho_{air}$=1.21 kg/m$^3$.

The value for the radial speed of sound $c_r$ derives from the conservation of the sound traveling along the radial direction:

$$\frac{(D - D_i)}{2c_r} = \frac{L}{c_{air}}. \tag{10}$$

The value for $\rho_r$ is derived from the impedance matching condition $c_r\rho_r = c_{air}\rho_{air}$ scaled by the enclosure's air-to-wall material filling ratio that varies along r.

The speaker enclosure 102 illustrated in FIGS. 1A and 1B, as well as the other disclosed enclosures, has a radially dependent density $$\rho_r = \frac{25\pi\rho_{air} r}{D},$$

with a bulk modulus $B = c_r^2\rho_r$, with the wavelength λ=7.14 D. Further, the radial speed of sound in the speaker enclosure $c_r = 0.266c_{air}$ Assuming the speaker enclosure has 10 channels, i.e., M=10, as illustrated in FIG. 1C, in order to approximate the values for the radial speed of sound $c_r$, the radial density $\rho_r$, and the azimuthal density $\rho_\theta$ discussed above, the sound path length of the channels L is set equal to 1.69 D and the width of the channels w is set equal to 0.03 D. Accordingly, as illustrated in FIG. 1C, the inner diameter $D_i$ is equal to 0.1 of the enclosure's diameter D, i.e., $D_i$=0.1 D.

Figure 2A:
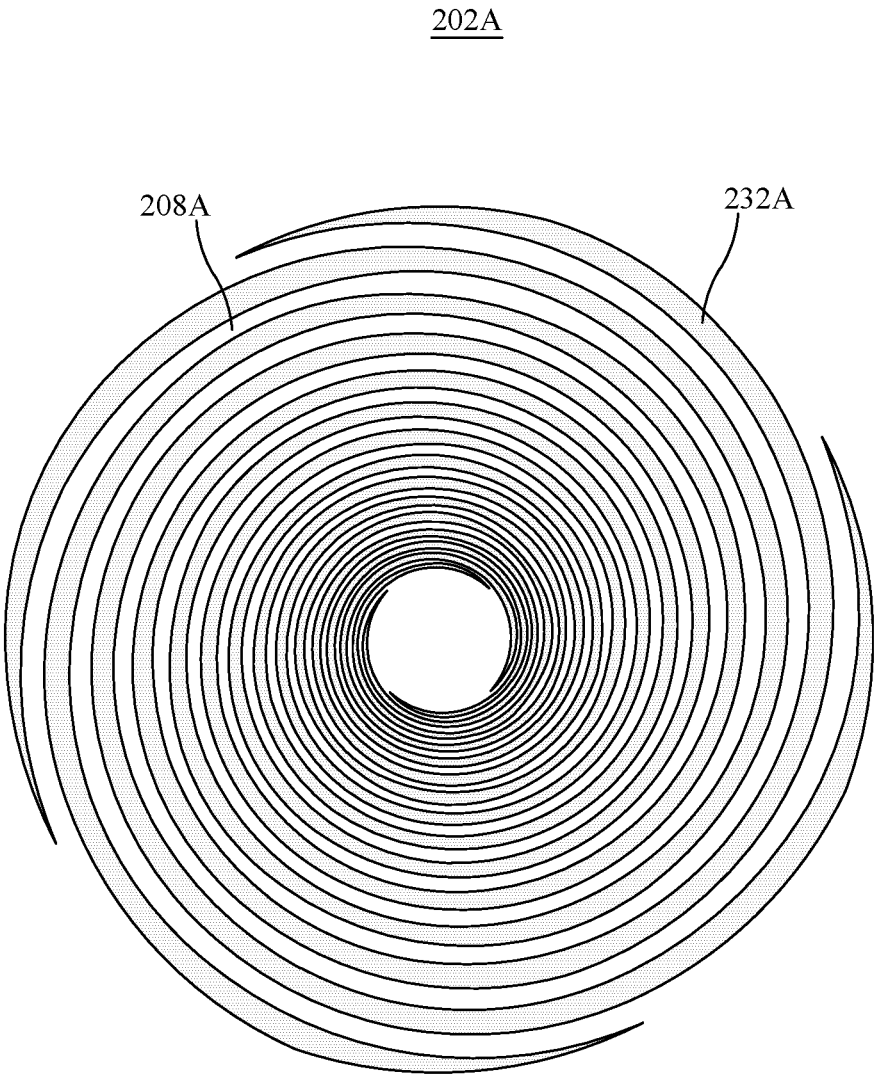
FIG. 2A is a schematic diagram of a speaker enclosure with spiral channels according to an embodiment.
Figure 2B:
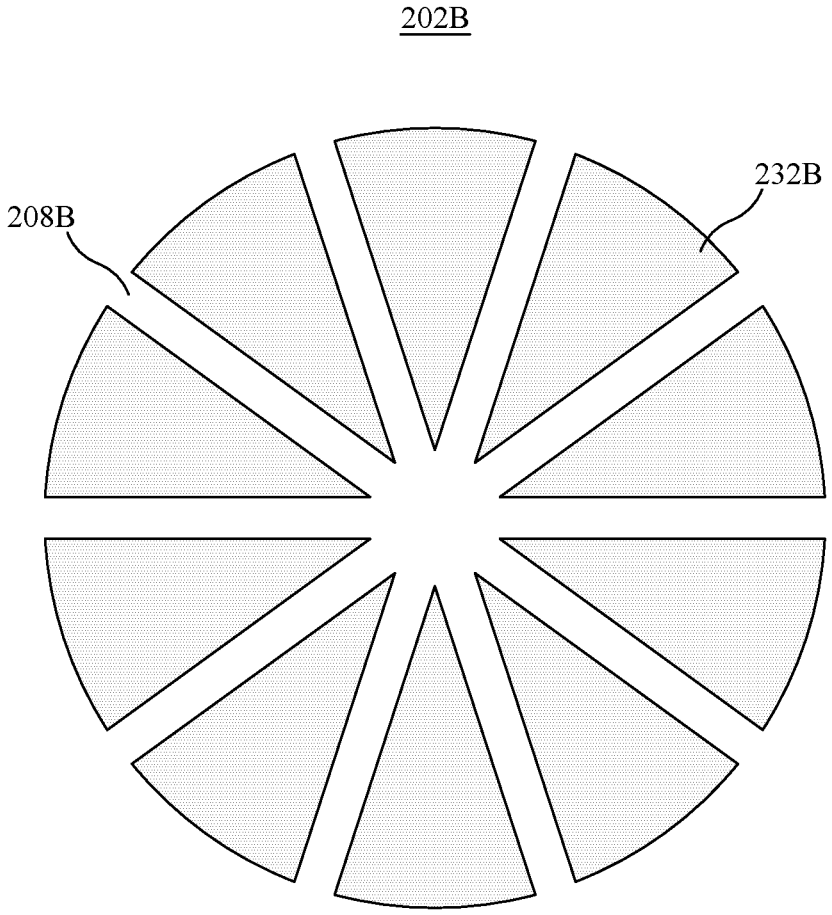
FIG. 2B is a schematic diagram of a speaker enclosure with linear channels according to an embodiment.

FIGS. 2A and 2B are schematic diagrams of speaker enclosures with different channel structures than those of the speaker enclosure of FIGS. 1A-C. The speaker enclosure 202A in FIG. 2A includes a plurality of spiral channels 208A defined by a plurality of spiral walls 232A. The speaker enclosure 202B of FIG. 2B includes a plurality of linear channels 208B defined by a plurality of pie slice shaped walls 232B. Similar to the speaker enclosure of FIGS. 1A-1C, the speaker enclosures of FIGS. 2A and 2B include a plurality of distinct channels beginning from the inner portion of the speaker enclosure and ending in the environment at an outer circumference of the speaker enclosure. Although particular channel configurations are described, the disclosed speaker enclosure can be employed with any type of channel configuration having paths that are equal to or longer than the radius of the enclosure as long as it is able to enhance sound radiation efficiency in an omnidirectional way. Although the speaker enclosure illustrated in FIG. 2B does not elongate the sound path, and therefore is not a subwavelength enclosure, the speaker enclosure still omnidirectionally enhances radiation efficiency.

Figure 2C:
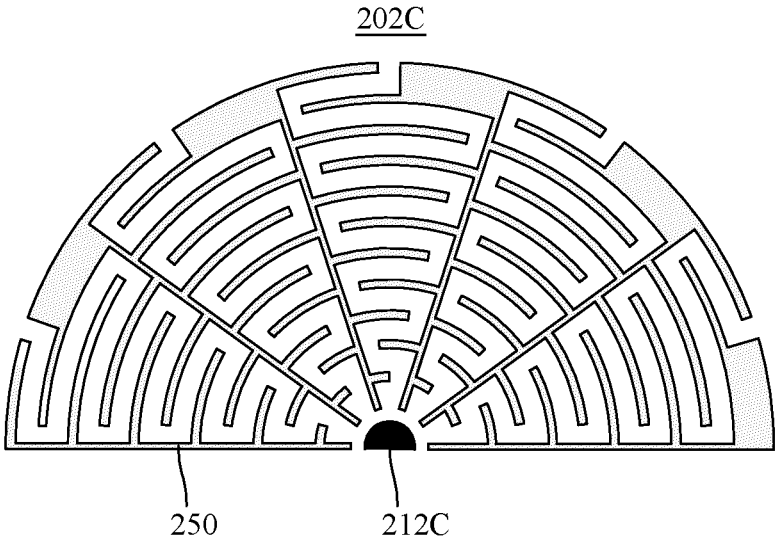
FIG. 2C is a schematic diagram of a speaker enclosure having a semi-circular geometry according to an embodiment.

Moreover, if omnidirectional sound is not critical, the speaker enclosure need not have an annular geometry. For example, as illustrated in FIG. 2C, the speaker enclosure 202C can be in the form of a semi-circle with the sound transducer 212C being configured to produce sound radiating in a direction of the channels. In one embodiment, the speaker enclosure may be a portion of a circle. One application in which a non-circular design may be useful is an automobile, in which the channels radiate towards the vehicle passengers and the back side of the enclosure 250 is arranged to face away from the passengers, which prevents low frequency sound from radiating towards the engine compartment of the automobile.

Figure 2D:
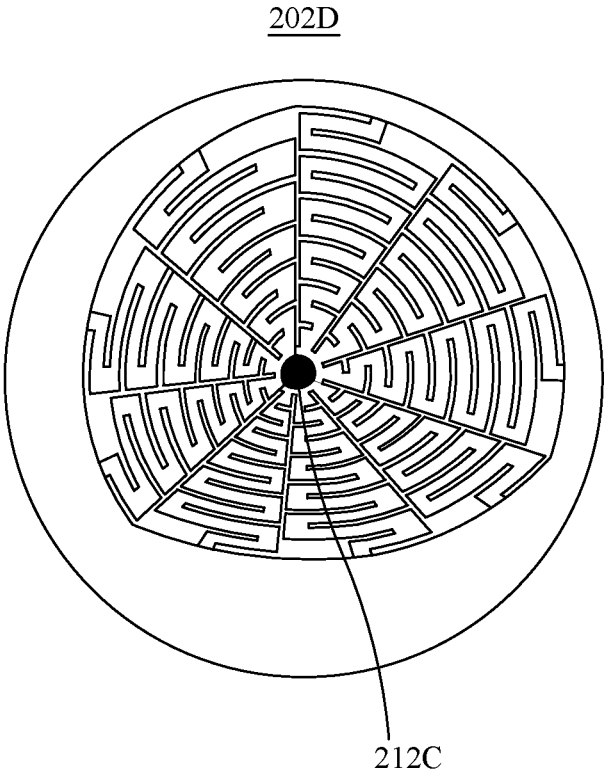
FIG. 2D is a schematic diagram of a speaker that produces three-dimensional sound according to an embodiment.

The speaker enclosures discussed above have a two-dimensional configuration. A three-dimensional configuration of a speaker enclosure to produce an omnidirectional three-dimensional sound is illustrated in FIG. 2D. FIG. 2D is a partial cross-sectional view of a spherical speaker enclosure 202D, which comprises an omnidirectional sound transducer 212 arranged in the center of the sphere so as to radiate sound in three dimensions. For ease of illustration, the outlets of the channels that are not visible in the figure are not illustrated. However, it will be recognized that the entire outer surface of the sphere will include channel outlets bounded by channel wall, the channel walls making up the structure of the outer surface of the sphere. In one application, the speaker enclosure may be shaped to be a fraction of a sphere.

Figure 3A:
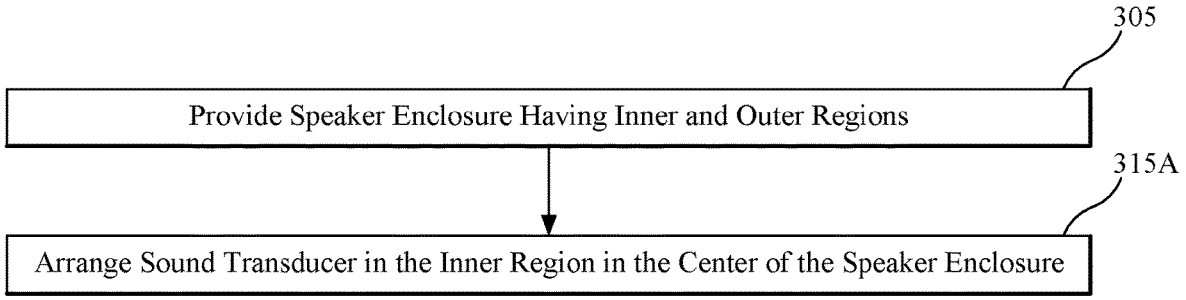
FIGS. 3A and 3B illustrate flowcharts of methods for making a speaker according to embodiments.
Figure 3B:
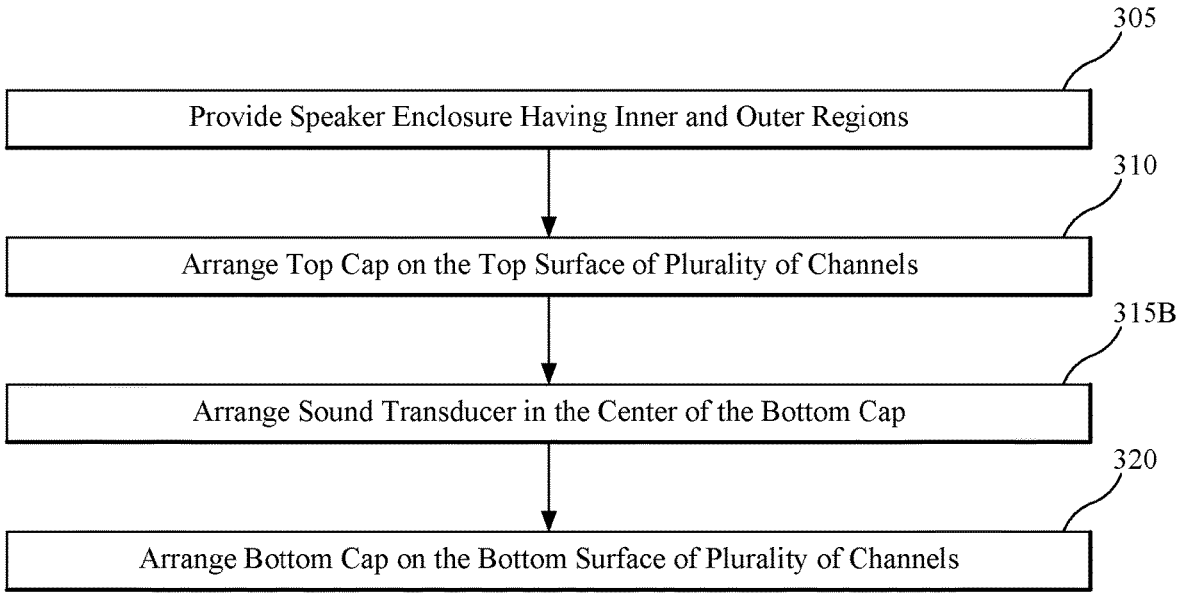

FIGS. 3A and 3B illustrate flowcharts of methods for making a speaker according to embodiments. Turning first to FIG. 3A, initially, a speaker enclosure 102, 202A, or 202B is provided (step 305). The speaker enclosure 102, 202A, or 202B comprises an inner region 104 arranged in a center of the speaker enclosure 102, 202A, or 202B. The speaker enclosure 102, 202A, or 202B also comprises an outer region 106, which surrounds the inner region 104 and includes a plurality of channels 108, 208A, or 208B connecting the inner region 104 to an environment 110 in which the speaker enclosure 102, 202A, or 202B is arranged. Next, a sound transducer 112 is arranged in the inner region 104 in the center of the speaker enclosure 102, 202A, or 202B (step 315A). Sounds produced by the sound transducer 112 radiate through the plurality of channels 108, 208A, or 208B into the environment 110. The length of each of the plurality of channels 108, 208A, or 208B is not shorter than a length from the center of the speaker enclosure 102, 202A, or 202B to the environment 110.

The method of FIG. 3B includes step 305, and further includes steps 310, 315B, and 320. Specifically, after providing the speaker enclosure 102, 202A, or 202B, the top cap 120 is arranged on a top surface 124 of the plurality of channels 108, 208A, or 208B and overhanging side surfaces 126 of the plurality of channels 108, 208A, or 208B (step 310). The sound transducer 112 is then arranged in the center of the bottom cap 122 (step 315B). Next, the bottom cap 122 is arranged on a bottom surface 128 of the plurality of channels 108, 208A, or 208B and overhanging the side surfaces 126 of the plurality of channels 108, 208A, or 208B (step 320). Accordingly, when the bottom cap is arranged on the bottom surface 128 of the plurality of channels with the sound transducer 112 is arranged in the center of the bottom cap 122, the sound transducer 112 is arranged in the inner region 104 in the center of the speaker enclosure 102, 202A, or 202B, which is why steps 315A and 315B have similar designations in the figures.

Although embodiments have been described above in connection with annular speaker enclosures, the disclosed speaker can also be implemented using speaker enclosures having other shapes, including semicircular, hexagonal, square, rectangular, etc. Speaker enclosures having these other shapes, however, may not provide omnidirectional sound that can be achieved with an annular enclosure. In the case of non-annular enclosures, references in the discussion above to diameter should be considered as the equivalent to the longest dimension of the speaker enclosure. Similarly, for non-annular enclosures, references in the discussion above to radius should be considered as the equivalent to the longest dimension from the center of speaker enclosure to the outside of the speaker enclosure.

In view of the discussion above, it will be recognized that the term speaker includes any type of apparatus including an enclosure and a sound transducer, including transducers, loudspeakers, woofers, subwoofers, etc.

The disclosed embodiments provide a speaker enclosure and speaker. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A speaker, comprising:

a speaker enclosure, comprising an inner region arranged in a center of the speaker enclosure;

an outer region, which surrounds the inner region and includes a plurality of channels connecting the inner region to an environment in which the speaker enclosure is arranged; and a sound transducer arranged in the inner region in the center of the speaker enclosure, wherein sound produced by the sound transducer radiates through the plurality of channels into the environment, wherein a length of each of the plurality of channels is greater than a length from the center of the speaker enclosure to the environment, and wherein the plurality of channels fully encloses the inner region in a transversal plane and communicates the inner region with the environment so that an azimuthal density $\rho_0$ of the speaker enclosure is infinite and a radial sound speed $c_r$ of the speaker enclosure is constant and smaller than a speed of sound in air.

2. The speaker of claim 1, wherein the speaker enclosure further comprises:

a top cap arranged on a top surface of the plurality of channels and overhanging side surfaces of the plurality of channels; and a bottom cap arranged on a bottom surface of the plurality of channels and overhanging the side surfaces of the plurality of channels.

3. The speaker of claim 2, wherein the side surfaces of the speaker enclosure have a height that is covered by portions of the top and bottom cap overhanging the side surfaces of the speaker enclosure.

4. The speaker of claim 1, wherein the channels are formed by rigid walls.

5. The speaker of claim 1, wherein the speaker enclosure is anisotropic.

6. The speaker of claim 1, wherein each of the plurality of channels are filled with a fluid.

7. The speaker of claim 1, wherein each of the plurality of channels are serpentine from the inner region to the environment.

8. The speaker of claim 1, wherein the plurality of channels are spirals beginning from the inner region and ending at the environment.

9. The speaker of claim 1, wherein each of the plurality of channels are distinct from each other and connect with each other only at the inner region and the environment.

10. The speaker of claim 1, wherein the speaker enclosure is annular and the speaker produces an omnidirectional sound.

11. The speaker of claim 10, wherein a diameter of the annular speaker enclosure is smaller than a wavelength of the sound produced by the sound transducer.

12. A method of producing a speaker, the method comprising:

providing a speaker enclosure, which comprises an inner region arranged in a center of the speaker enclosure;

an outer region, which surrounds the inner region and includes a plurality of channels connecting the inner region to an environment in which the speaker enclosure is arranged; and arranging a sound transducer in the inner region in the center of the speaker enclosure, wherein sound produced by the sound transducer radiates through the plurality of channels into the environment, wherein a length of each of the plurality of channels is greater than a length from the center of the speaker enclosure to the environment, and wherein the plurality of channels fully encloses the inner region in a transversal plane and communicates the inner region with the environment so that an azimuthal density $\rho_0$ of the speaker enclosure is infinite and a radial sound speed $c_r$ of the speaker enclosure is constant and smaller than a speed of sound in air.

13. The method of claim 12, further comprising:

arranging a top cap on a top surface of the plurality of channels and overhanging side surfaces of the plurality of channels; and arranging a bottom cap on a bottom surface of the plurality of channels and overhanging the side surfaces of the plurality of channels.

14. An omnidirectional speaker, comprising:

an annular speaker enclosure, comprising an inner region arranged in a center of the annular speaker enclosure;

an outer region, which surrounds the inner region and includes a plurality of channels connecting the inner region to an environment in which the annular speaker enclosure is arranged; and a sound transducer arranged in the inner region in the center of the annular speaker enclosure, wherein sound produced by the sound transducer radiates through the plurality of channels into the environment, wherein a length of each of the plurality of channels is greater than a radius of the annular speaker enclosure, and wherein the plurality of channels fully encloses the inner region in a transversal plane and communicates the inner region with the environment so that an azimuthal density $\rho_0$ of the speaker enclosure is infinite and a radial sound speed $c_r$ of the speaker enclosure is constant and smaller than a speed of sound in air.

15. The omnidirectional speaker of claim 14, wherein a diameter of the annular speaker enclosure is smaller than a wavelength of the sound produced by the sound transducer.

16. The omnidirectional speaker of claim 14, wherein the annular speaker enclosure further comprises:

an annular top cap arranged on a top surface of the plurality of channels and overhanging side surfaces of the plurality of channels; and an annular bottom cap arranged on a bottom surface of the plurality of channels and overhanging the side surfaces of the plurality of channels.

17. The omnidirectional speaker of claim 16, wherein the side surfaces of the annular speaker enclosure have a height that is covered by portions of the top and bottom cap overhanging the side surfaces of the annular speaker enclosure.

18. The omnidirectional speaker of claim 14, wherein the channels are formed by rigid walls.

19. The omnidirectional speaker of claim 18, wherein the annular speaker enclosure is anisotropic.

20. The omnidirectional speaker of claim 14, wherein each of the plurality of channels are filled with a fluid.

* * * * *